US011454078B2

(12) United States Patent
Nelson et al.

(10) Patent No.: US 11,454,078 B2
(45) Date of Patent: Sep. 27, 2022

(54) NON-ORIENTATING TUBING HANGER AND TREE

(71) Applicant: Dril-Quip, Inc., Houston, TX (US)

(72) Inventors: John E. Nelson, Houston, TX (US); Frank D. Kalb, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/286,214

(22) PCT Filed: Oct. 18, 2019

(86) PCT No.: PCT/US2019/056898
§ 371 (c)(1),
(2) Date: Apr. 16, 2021

(87) PCT Pub. No.: WO2020/081911
PCT Pub. Date: Apr. 23, 2020

(65) Prior Publication Data

US 2021/0340831 A1 Nov. 4, 2021

Related U.S. Application Data

(60) Provisional application No. 62/747,280, filed on Oct. 18, 2018.

(51) Int. Cl.
*E21B 33/04* (2006.01)
*E21B 17/02* (2006.01)

(52) U.S. Cl.
CPC ..... *E21B 33/04* (2013.01); *E21B 17/028* (2013.01)

(58) Field of Classification Search
CPC ..... E21B 33/04; E21B 17/028; E21B 17/02; E21B 23/01; E21B 33/03
See application file for complete search history.

(56) References Cited

U.S. PATENT DOCUMENTS

| | | | | |
|---|---|---|---|---|
| 5,052,941 | A | 10/1991 | Hernandez-Marti et al. | |
| 6,681,861 | B2 | 1/2004 | Davidson et al. | |
| 2004/0159439 | A1* | 8/2004 | Fenton | E21B 33/043 166/368 |
| 2007/0039738 | A1* | 2/2007 | Fenton | E21B 47/09 166/368 |

(Continued)

OTHER PUBLICATIONS

International Search Report and Written Opinion issued in related PCT Application No. PCT/US2019/056898 dated Feb. 6, 2020, 12 pages.

*Primary Examiner* — James G Sayre
(74) *Attorney, Agent, or Firm* — Baker Botts L.L.P.

(57) ABSTRACT

Systems and methods for landing a tubing hanger in a wellhead, landing a tree on the wellhead, and making electrical and hydraulic couplings between the tree and the tubing hanger without having to orient the tree or the tubing hanger relative to each other are provided. This is accomplished using a seal sub that is coupled to the tree and lowered with the tree into contact with the tubing hanger located in the wellhead. The seal sub features an electrical conductor that facilitates electrical coupling of the tree to the tubing hanger. The tubing hanger and seal sub may include a metal-to-metal and elastomeric seal arrangement designed to seal off electrical and hydraulic connections between these components when, the tree is positioned within the wellhead.

20 Claims, 5 Drawing Sheets

(56) References Cited

U.S. PATENT DOCUMENTS

| | | | | |
|---|---|---|---|---|
| 2009/0211761 | A1* | 8/2009 | Broussard | E21B 33/043 166/368 |
| 2012/0222866 | A1* | 9/2012 | Sneed | E21B 23/01 166/348 |
| 2018/0179839 | A1 | 6/2018 | Nguyen | |

* cited by examiner

NON-ORIENTATING TUBING HANGER AND TREE

CROSS-REFERENCE TO RELATED APPLICATIONS

The present application is a U.S. National Stage Application of International Application No. PCT/US2019/056898 filed Oct. 18, 2019, which claims priority to U.S. Provisional Application Ser. No. 62/747,280 filed on Oct. 18, 2018 both of which are incorporated herein by reference in their entirety for all purposes.

TECHNICAL FIELD

The present disclosure relates generally to wellhead systems and, more particularly, to a non-orientating tubing hanger and tree with a seal sub that facilitates electrical and hydraulic connections between the tree and the tubing hanger regardless of the orientation in which the tree is positioned, relative to the wellhead and tubing hanger.

BACKGROUND

Conventional wellhead systems include a wellhead housing mounted on the upper end of a subsurface casing string extending into the well bore. During a drilling phase, a drilling riser and BOP are installed above a wellhead housing (casing head) to provide pressure control as casing is installed, with each casing string having a casing hanger on its upper end for landing on a shoulder within the wellhead housing. A tubing string is then installed through the well bore. A tubing hanger connected to the upper end of the tubing string is supported within the wellhead housing above the casing hanger to suspend the tubing string within the casing string. Upon completion of this process, the BOP is replaced by a Christmas tree installed above the wellhead housing, with the tree having production and annulus valves to enable the oil or gas to be produced and directed into flow lines for transportation to a desired facility.

Conventionally, the tubing hanger contains numerous bores and couplings, which require precise alignment with corresponding portions of the tree. There are two ways to achieve orientation of such a tree relative to a tubing hanger. The first uses a tubing spool assembly, which latches to the wellhead and provides landing and orientation features. The tubing spool is very expensive, however, and adds height to the overall stuck-up. Additionally, the drilling riser must be retrieved to install the tubing spool. The drilling riser will that be redeployed and connected to the tubing spool, for installing the tubing hanger. It frequently requires installation by expensive drilling vessels.

The second method of orienting a tree relative to a tubing hanger involves the use of a blowout preventer ("BOP") stack with a hydraulic orientation pin and tubing hanger orientation adapter joint. This method requires detailed knowledge of the particular BOP stack in order to accurately install a hydraulically actuated pin, which protrudes into the BOP stack bore. An orientation helix is attached above the tubing hanger running tool, and, as the tubing hanger is installed, the helix engages the hydraulic pin and orientates the tubing bores to a defined direction. This method requires accurate drawings of the BOP stack elevations and spacing between the main bore and the outlet flanges, which may require hours of surveying and multiple trips to make measurements. Room for error exists with this method, particularly in older rigs. Thus, this method requires significant up-front planning.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
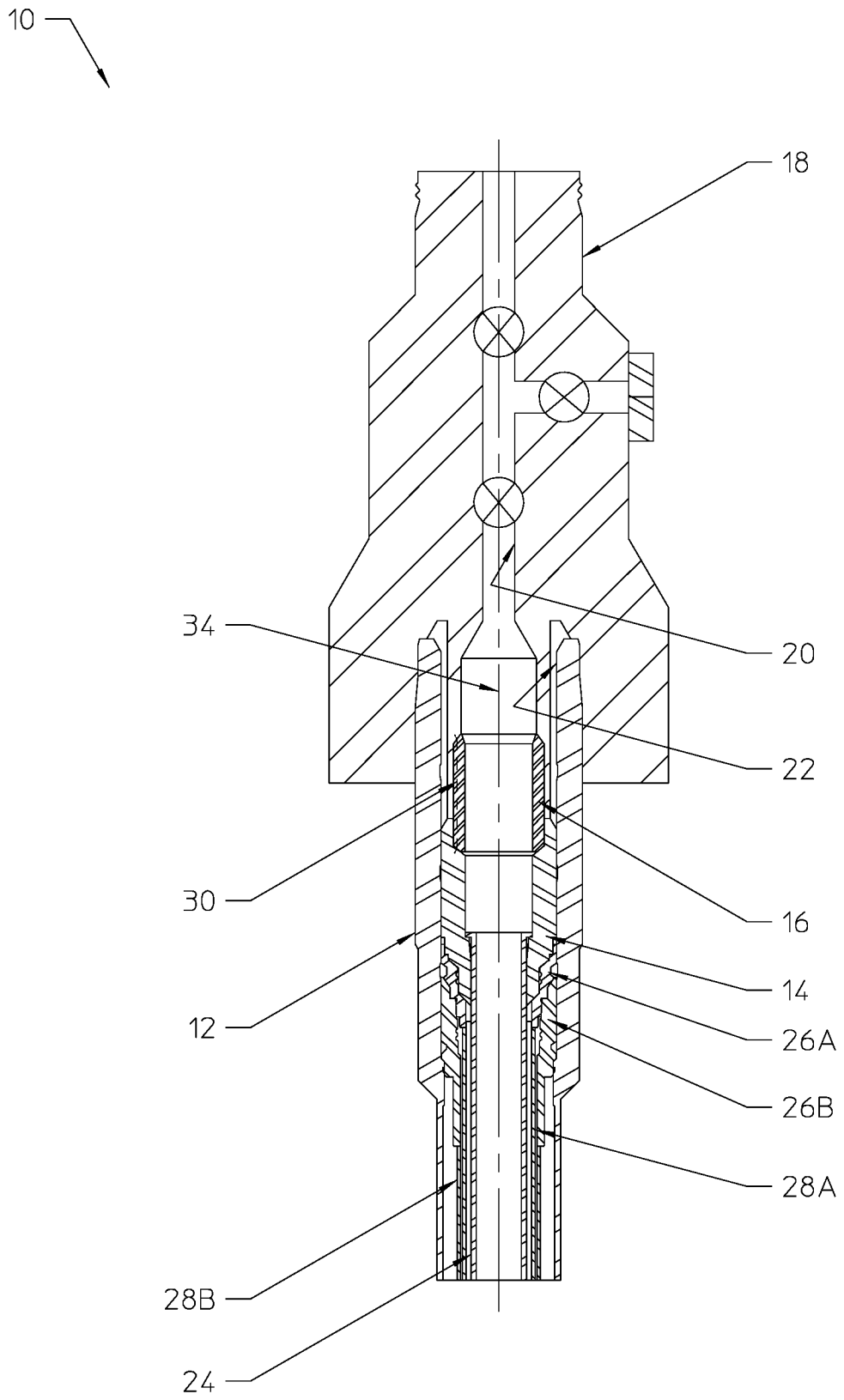
FIG. 1 is a schematic cutaway view of components of a production system having a non-orientating tubing hanger and tree with a seal sub, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Existing wellhead systems generally include a tubing hanger that is disposed within a wellhead to hold a tubing string deployed downhole, and a tree that is positioned on the wellhead to form fluid connections to downstream components. Electrical, hydraulic, and/or fiber optic signals are often communicated through the wellhead system, between the tree and the tubing hanger. In existing wellhead systems, a tree that is positioned on the wellhead must be properly oriented with respect to the tubing hanger that is set in the wellhead to make up multiple couplings or stabs between the tubing hanger and the tree. These couplings or stabs allow electric, hydraulic, and/or fiber optic signals to be communicated from the tree to the tubing hanger and various downhole components. Existing methods for orienting a tree relative to a tubing hanger in the wellhead involve the use of either an expensive tubing spool or a BOP stack orientation pin and tubing hanger running tool orientation adapter joint, which can be difficult to properly place on the wellhead and expensive to adjust if improperly placed.

The present disclosure is directed to systems and methods for landing a tubing hanger in a wellhead, landing a tree on the wellhead, and making electrical and hydraulic couplings between the tree and the tubing hanger without having to orient the tree or the tubing hanger relative to each other. This is accomplished without the use of either a tubing spool or a BOP stack with an orientation pin. The disclosed tubing hanger and tree are considered "non-orientating," meaning that neither of these components need be oriented with respect to each other or the wellhead to make the electrical and hydraulic connections therebetween.

The disclosed system and method involves a seal sub that is coupled to the tree and lowered with the tree into contact with the tubing hanger located in the wellhead. The seal sub features an electrical connection that facilitates electrical coupling of the tree to the tubing hanger. The tubing hanger and seal sub may include a metal-to-metal and elastomeric seal arrangement designed to seal off the electrical connection when the tree is positioned within the wellhead. The tubing hanger is equipped with an inner gallery of hydraulic fluid ports and one or more stinger checks that are spring loaded. The spring-loaded checks are designed to slide upward when the inner gallery of the tubing hanger is not sealed against by either a running tool or the seal sub, thereby closing a hydraulic communication port through the tubing hanger to prevent sea water intrusion.

The disclosed system and method enables an operator to lower a tubing hanger into a wellhead and then subsequently position a tree within the wellhead at any orientation relative to the tubing hanger while still making the required electrical, hydraulic, and/or fiber optic connections between the tree and the tubing hanger. Thus, the system provides time and economic savings during the construction and completion of the subsea system.

Turning now to the drawings, FIG. 1 illustrates certain components of a subsea production system 10 in which the disclosed non-orientating tubing hanger, tree, and seal sub may be utilized. The production system 10 depicted in FIG. 1 may include a wellhead 12, a tubing hanger 14, a seal sub 16, and a production tree 18. The production tree 18 may include various valves for fluidly coupling a vertical bore 20 formed through the tree 18 to one or more downstream production flowpaths, such as a well jumper. The tree 18 may be connected to and scaled against the wellhead 12. The tubing hanger 14 may be fluidly coupled to the bore 20 of the tree 18. When the tree 18 is landed in the wellhead 12, as shown, the seal sub 16 disposed on the tree 18 may be connected to the tubing hanger 14.

The tubing hanger 14 may be landed in and sealed against a bore 22 of the wellhead 12, as shown. The tubing hanger 14 may suspend a tubing string 24 into and through the wellhead 12. Likewise, one or more casing hangers (e.g., inner casing hanger 26A and outer casing hanger 26B) may be held within and sealed against the bore 22 of the wellhead 12 and used to suspend corresponding casing strings (e.g., inner casing string 28A and outer casing string 28B) through the wellhead 12.

In the illustrated embodiment, the seal sub 16 may include one or more communication lines (e.g., hydraulic fluid lines, electrical lines, and/or fiber optic lines) 30 disposed therethrough and used to communicatively couple the tree 18 to the tubing hanger 14. The seal sub 16 is designed to establish hydraulic, electric, and/or fiber optic communication between the tree 18 and the tubing hanger 14 regardless of the orientations (relative to longitudinal axis 34) in which the tree 18 and the tubing hanger 14 are landed in the wellhead 12.

Figure 2:
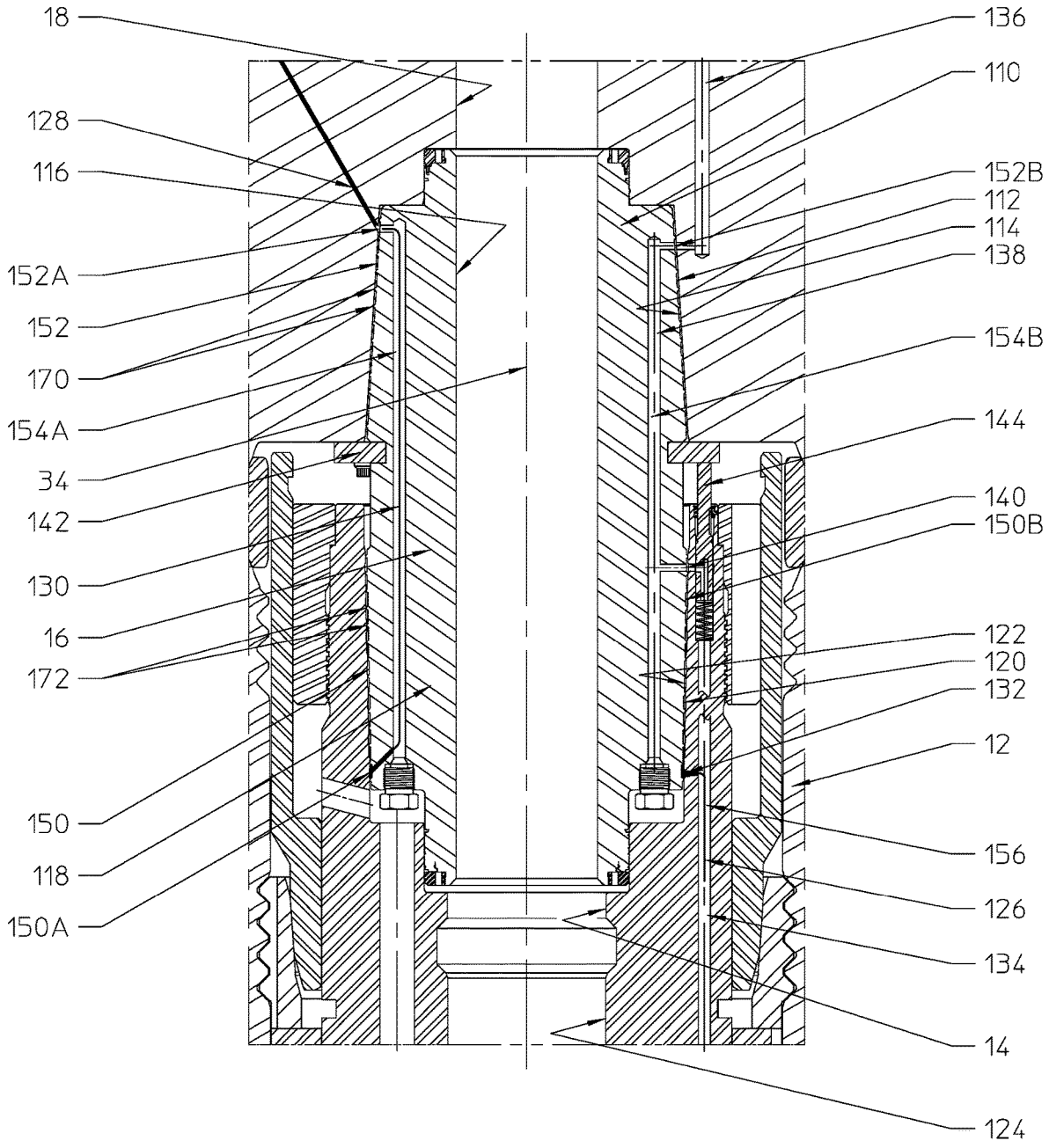
FIG. 2 is a cross-sectional view of a production system having a non-orientating tubing hanger and tree with a seal sub, in accordance with an embodiment of the present disclosure.

FIG. 2 provides a more detailed view of an embodiment of the production system 10 including the non-orientating tubing hanger 14 and the tree 18 with the seal sub 16. In the illustrated embodiment, an upper end 110 of the seal sub 16 is disposed within an opening at a lower end of the tree 18. A radially outer wall 112 of the upper end 110 of the seal sub 16 interfaces with a corresponding radially inner wall 114 formed at the lower end of the tree 18. The seal sub 16 generally has a boar 116 formed therethrough that is longitudinally aligned with the boar 20 through the tree 18. As illustrated, the bore 116 of the seal sub 16 may have approximately the same diameter as the corresponding bore 20 of the tree 18.

In the illustrated embodiment, a lower end 118 of the seal sub 16 is disposed within an opening at an upper end of the tubing hanger 14. A radially outer wall 120 of the lower end 118 of the seal sub 16 interfaces with a corresponding radially inner wall 122 at the upper end of the tubing hanger 14. The tubing hanger 14 generally has a bore 124 formed therethrough that is longitudinally aligned with the bore 116 of the seal sub 16. As illustrated, the bore 116 of the seal sub 16 may have approximately the same diameter as the corresponding bore 124 of the tubing hanger 14.

FIG. 2 illustrates the tubing hanger 14, seal sub 16, and tree 18 in fully landed positions within and/or on the wellhead 12. That is, the tubing hanger 14 is landed in a desired position within a bore of the wellhead 12, and the seal sub 16 and tree 18 are both landed such that the seal sub 16 is disposed within and engaged with the tubing hanger 14. In this landed position, the seal sub 16 provides electric, fiber optic, and/or hydraulic communication between the tree 18 and the tubing hanger 14 regardless of the relative orientation (about axis 34) of the tree 18 with respect to the tubing hanger 14.

In the illustrated arrangement, the seal sub 16 is attached to the tree 18 in such a manner that the tree 18 and seal sub 16 may be lowered together onto the tubing hanger 14 for positioning of these components in their landed positions.

In other embodiments, however, the seal sub 16 may instead be attached to the tubing hanger 14 such that the seal sub 16 is lowered into the wellhead 12 along with the tubing hanger 14 and the tree 18 is later lowered down onto the tubing hanger 14 and seal sub 16.

As illustrated, the tubing hanger 14 and the tree 18 may each include at least one electrical or fiber optic communication line (126 of the tubing hanger 14 and 128 of the tree 18). The seal sub 16 also may include at least one corresponding electrical or fiber optic communication line 130. The electrical/fiber optic line(s) 130 of the seal sub 16 may be extensions of the same electrical/fiber optic line(s) 128 of the tree 18 coupled to the seal sub 16. The electrical/fiber optic line(s) 130 of the seal sub 16 may be electrically coupled to the electrical/fiber optic line(s) 126 of the tubing hanger 14 via an electrical connection 132 located at an interface of the radially inner wall 122 of the tubing hanger 14 and the radially outer wall 120 of the seal sub 16. The type and arrangement of electrical connection 132 that may be utilized in the production system 10 is described below with reference to FIGS. 4 and 5.

In some embodiments, the electrical/fiber optic line(s) 130 of the seal sub 16 may be similarly coupled to the electrical/fiber optic line(s) 128 of the tree 18 via an electrical connection located at an interface of the radially inner wall 114 of the tree 18 and the radially outer wall 112 of the seal sub 16.

The tubing hanger 14 and the tree 18 may each include at least one hydraulic fluid conduit (134 of the tubing hanger 14 and 136 of the tree 18). The seal sub 16 also may include at least one corresponding hydraulic fluid conduit 138. The seal sub 16 may be oriented relative to the tree 18 such that the hydraulic fluid conduit(s) 138 of the seal sub 16 is aligned in a radial direction with the corresponding hydraulic fluid conduit(s) 136 of the tree 18. The hydraulic fluid conduit(s) 138 of the seal sub 16 may be fluidly coupled to the hydraulic fluid conduits) 134 of the tubing hanger 14 via a fluid connection 140 located at an interface of the radially inner wall 122 of the tubing hanger 14 and the radially outer wall 120 of the seal sub 16. The type and arrangement of the fluid connection 140 that may be utilized in the production system 10 is described below with reference to FIG. 3.

In some embodiments, the hydraulic fluid conduit(s) 138 of the seal sub 16 may be similarly coupled to the hydraulic fluid conduit(s) 136 of the tree 18 via a fluid connection located at an interface of the radially inner wall 114 of the tree 18 and the radially outer wall 112 of the seal sub 16.

The seal sub 16 may be attached to the lower end of the tree 18 by any desired attachment mechanism. As one example, the illustrated seal sub 16 is attached to the lower end of the tree 18 via a locking ring (e.g., c-shaped locking ring) 142 or flange that is received into an indentation formed in the radially outer wall 112 of the seal sub 16. The flange portion of the locking ring 142 or flange may be bolted directly to the tree 18, thereby attaching the seal sub 16 to the tree 18 so that the seal sub 16 can be lowered into position with the tree 18.

Although the illustrated embodiment shows the seal sub 16 attached to the tree 18 for positioning within the wellhead 12, other embodiments of the production system 10 may include the seal sub 16 as an attachment to the tubing hanger 14 such that the seal sub 16 is initially lowered with the tubing hanger 14 into position within the wellhead 12. In such embodiments, an attachment mechanism (e.g., locking ring, flange, etc.) may be used to directly couple the seal sub 16 to the tubing hanger 14, instead of the tree 18. The electrical/fiber optic line(s) 128 of the tree 18 and line(s) 130 of the seal sub 16 would be connected via one or more electrical galleries, and the hydraulic fluid conduit(s) 136 of the tree 18 and conduit(s) 138 of the seal sub 16 would be connected via one or more fluid galleries. The electrical/fiber optic line(s) 130 of the seal sub 16 may be an extension of the same electrical/fiber optic line(s) 126 of the tubing hanger 14, and the hydraulic fluid conduit(s) 138 of the seal sub 16 may be aligned in a radial direction with the corresponding hydraulic fluid conduit(s) 134 of the tubing hanger 14.

The seal sub 16 may include a one-way valve (not shown) in the hydraulic fluid conduit 138 that prevents seawater intrusion into the conduits 138 and 136 of the seal sub 16 and tree 18 as these components are deployed to the wellhead 12. The tubing hanger 14 may include a biased check assembly 144 designed to facilitate alignment of the fluid conduit 134 of the tubing hanger 14 with the fluid connection 140 only when the tree 18 and seal sub 16 are in the landed position on the tubing hanger 14. The check assembly 144 will be described in detail with respect to FIG. 3. The check assembly 144 may prevent seawater intrusion into the conduit 134 of the tubing hanger 14 during the time in which the tubing hanger 14 is in position in the wellhead 12 and before the seal sub 16 and tree 18 are landed.

In embodiments where the seal sub 16 is attached to and lowered into position along with the tubing hanger 14 instead of the tree 18, the tree 18 may be equipped with a biased check assembly.

The seal sub 16 is equipped with two different types of gallery metal-to-metal seals, one type of seal 170 provided on the outer wall 112 on the upper portion of the seal sub 16 and the other type of seal 172 provided on the outer wall 120 on the lower portion of the seal sub 16. The first type of seal 170 provided on the outer wall 112 is designed to seal an interface between the seal sub 16 and the tree 18 when the seal sub 16 is attached to the tree 18. The second type of seal 172 provided on the outer wall 120 is designed to seal an interface between the seal sub 16 and the tubing hanger 14 once the seal sub 16 has been lowered into engagement with the tubing hanger 14. On the tree side of the seal sub (i.e., outer wall 112), the metal-to-metal seals 170 may include elastomeric backups, and the metal-to-metal seals 170 may be preloaded on a tapered surface (inner wall 114) of the tree 18. When the seal sub 16 is fastened to the tree 18 (e.g., via the locking ring 142), die tree 18 maintains the preload on the metal-to-metal seals 170. The seals 172 on the tubing hanger side of the seal sub 16 will be described below with reference to FIG. 3.

Figure 3:
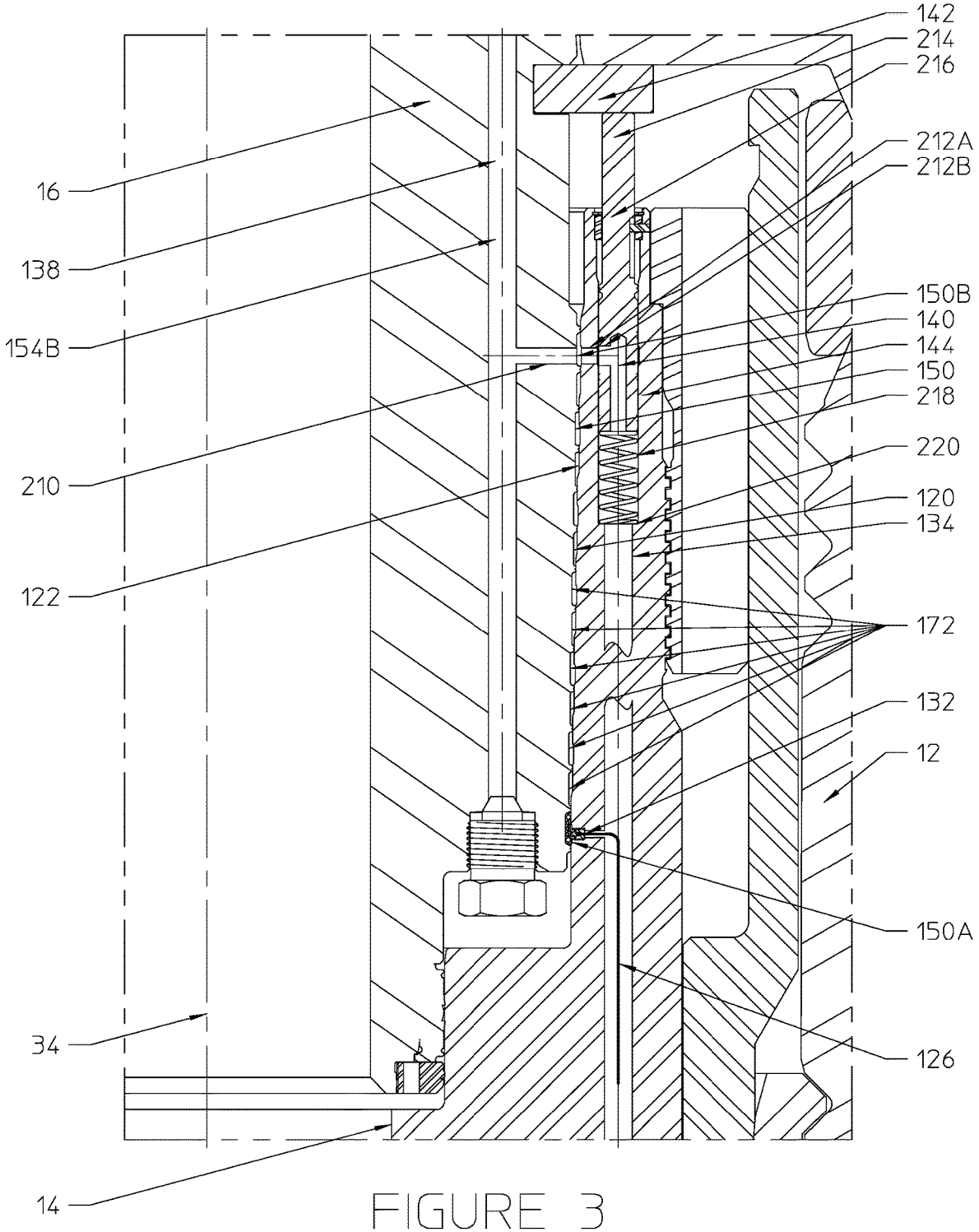
FIG. 3 is an expanded cross-sectional view of a portion of the production system of FIG. 2, in accordance with an embodiment of the present disclosure.

Several metal-to-metal seals (170, 172) may be made up on either portion (upper or lower) of the seal sub 16 to provide a desired number of sealed zones independent from each other within the seal sub 16. When the metal-to-metal seals are made up, they create a gallery of these sealed zones. For example, FIG. 3 shows a plurality of these zones 150 formed between the outer wall 120 of the seal sub 16 and the tubing hanger 14 via a series of metal-to-metal seals 172 on the seal sub 16. Turning back to FIG. 2, similar types of zones 152 are formed between the outer wall 112 of the seal sub 16 and the tree 18 via a series of metal-to-metal seals 170.

One or more zones 150 on the lower part of the seal sub 16 may be communicatively coupled to one or more zones 152 on the upper part of the seal sub 16 via passages that are drilled through the body of the seal sub 16. As shown in FIG. 2, the seal sub 16 may include at least a first passage 154A for routing the electrical/fiber optic line 130 between one of the upper level sealed zones 152A and one of the lower level sealed zones 150A. The seal sub 16 may also include a second passage 154B, which is the hydraulic fluid conduit 138, for routing hydraulic fluid between one of the upper level sealed zones 152B and one of the lower level scaled zones 150B. It should be noted that the different upper level scaled zones 152A and 152B are independent from each other and separated via the metal-to-metal seals 170, and the lower level scaled zones 150A and 150B are independent from each other and separated via the metal-to-metal seals 172. However, as shown in FIG. 2, the separate passages 154A and 154B through the seal sub 16 may provide both electrical and hydraulic communications from the seal sub 16 ultimately to the same passage 156 (conduit 134) formed through the tubing hanger 14. However, the communication signals are provided to this same passage 156 through two different lower level sealed zones 150A and 150B.

The sealed zones 150/152 are generally concentric and extend a full 360 degrees around the outer walls of the seal sub 16, so that communication through the seal sub 16 is possible at any angle. That way, the sealed zones 150/152 allow fluids or electrical connections to pass through the seal sub 16 without the seal sub 16 needing to be at a specific orientation relative to the tubing hanger 14 or to the tree 18.

FIG. 3 illustrates the connections (132 and 140) formed between the seal sub 16 and die tubing hanger 14. As mentioned above, the seal sub 16 includes gallery metal-to-metal seals 172 on the outer wall 120 of the seal sub 16, and these metal-to-metal seals 172 define the multiple zones 150. The metal-to-metal seals 172 formed on this tubing hanger side of the seal sub 16 may each include metal-to-metal seal bumps with an elastomer back-up capable of siding on a straight seal pocket of the tubing hanger inner wall 122. Engaging a straight wall of the tubing hanger 14 via die metal-to-metal seals 172 in this manner, as opposed to a tapered wall, allows the system to accommodate possible elevation differences of the tubing hanger 14 within the wellhead 12.

As illustrated, the seal sub 16 includes at least one electrical connection 132 formed in one of the sealed zones 150A along the outer wall 120 of the seal sub 16 and at least one hydraulic connection 140 formed in one of the sealed zones 150B along the outer wall 120. In some embodiments, the seal sub 16 may also include at least one zone 150 along the outer wall 120 designed to accommodate an electrical to fiber optic cable connection (not shown).

At the hydraulic connection 140, the seal sub 16 may include a fluid passage 210 that extends radially outward from the hydraulic fluid passage 154B through the seal sub 16 to fluidly couple the fluid passage 154B to the sealed zone 150B formed between adjacent metal-to-metal seals 172 on the outer wall 120. The tubing hanger 14 may include a similar fluid passage 212 that extends radially inward from the hydraulic fluid passage 134 through the tubing hanger 14 to fluidly couple the fluid passage 134 to the sealed zone 150B. In some embodiments, the fluid passage 212 may be formed from at least two portions 212A and 212B that are brought into alignment with each other and with the sealed zone 150B only once the seal sub 16 is landed in the tubing hanger 14.

The fluid passages 210 and 212 of the seal sub 16 and tubing hanger 14, respectively, along with the sealed hydraulic fluid zone 150B of the seal sub 16 provide fluid communication between the hydraulic conduit 138 of the seal sub 16 and the hydraulic conduit 134 of the tubing hanger 14. This hydraulic connection 140 is provided regardless of the orientation of the seal sub 16 relative to the tubing hanger 14 when the seal sub 16 is landed. Since the sealed zone 150B extends 360 degrees about the seal sub 16, hydraulic fluid may enter the sealed zone 150B from the fluid passage 210 of the seal sub 16 when the fluid passage 210 is at any circumferential position about the axis 34. The hydraulic fluid may then exit the sealed zone 150B via the fluid passage 212 of the tubing hanger 14 when the fluid passage 212 is at any circumferential position about the axis 34.

As mentioned above, the tubing hanger 14 may be equipped with a biasing check assembly 144. The biasing check assembly 144 is configured to bring the two portions 212A and 212B of the fluid passage 212 of the tubing hanger 14 into alignment so that they are fluidly coupled in response to the seal sub 16 being landed on the tubing hanger 14. The check assembly 144 may include a piston 216 and a biasing mechanism such as a spring 218 disposed between the piston 216 and a shoulder 220 formed in the tubing hanger 14. The piston 216 includes a portion of the fluid passage 134 and the portion 212B of the fluid passage 212 formed therethrough. An extended portion 214 (check) of the piston 216 extends upward from the tubing hanger 14.

When the tree 18 and seal sub 16 are landed on the tubing hanger 14, the locking ring 142 (or some other portion of the seal sub 16) engages and presses downward against the extended portion 214 of the piston 216. The downward force from the seal sub 16 onto the extended portion 214 pushes the piston 216 further into a chamber formed in the tubing hanger 14. When the seal sub 16 and tree 18 reach the landed position, the piston 216 remains held in place such that the fluid passage 212B of the piston 216 is aligned with the fluid passage 212A of the tubing hanger 14. At this point, the seal sub 16 will also be at a position where the sealed hydraulic fluid zone 150B is aligned in an axial direction with the fluid passage 212A of the tubing hanger 14.

When the seal sub 16 is not engaged with the tubing hanger 14 (e.g., via downward force on the extended portion 214 of the piston 216), the spring 218 biases the piston 216 in an upward direction within the chamber in the tubing hanger 14. In this position, the fluid passage 212B is no longer aligned with the corresponding fluid passage 212A of the tubing hanger 14. The biasing check assembly 144 is therefore able to automatically seal the entryway to the hydraulic fluid passage 126 of the tubing hanger 14 so that sea water does not flow into the tubing hanger 14 via the exposed fluid passage 212A when the seal sub 16 is removed.

Although FIG. 3 illustrates the fluid passage 210 of the seal sub 16 as being at the same orientation about axis 34 as the radially inwardly extending fluid passage 212(A and B) of the tubing hanger 14, this is only to show how each side interfaces with the sealed fluid connection zone 150B. When the seal sub 16 is fully landed, the fluid passages 210 and 212 will be in fluid communication regardless of the orientation of the seal sub 16 relative to the tubing hanger 14 since the sealed fluid connection zone 150B extends through all 360 degrees about the seal sub 16. The fluid passage 210 of the seal sub 16 may be located at one position along the circumference of the assembly while the fluid passage 212 of the tubing hanger 14 may be located at another circumferential position, but these fluid passages 210 and 212 are still connected through the sealed hydraulic fluid zone 150B.

Figure 4:
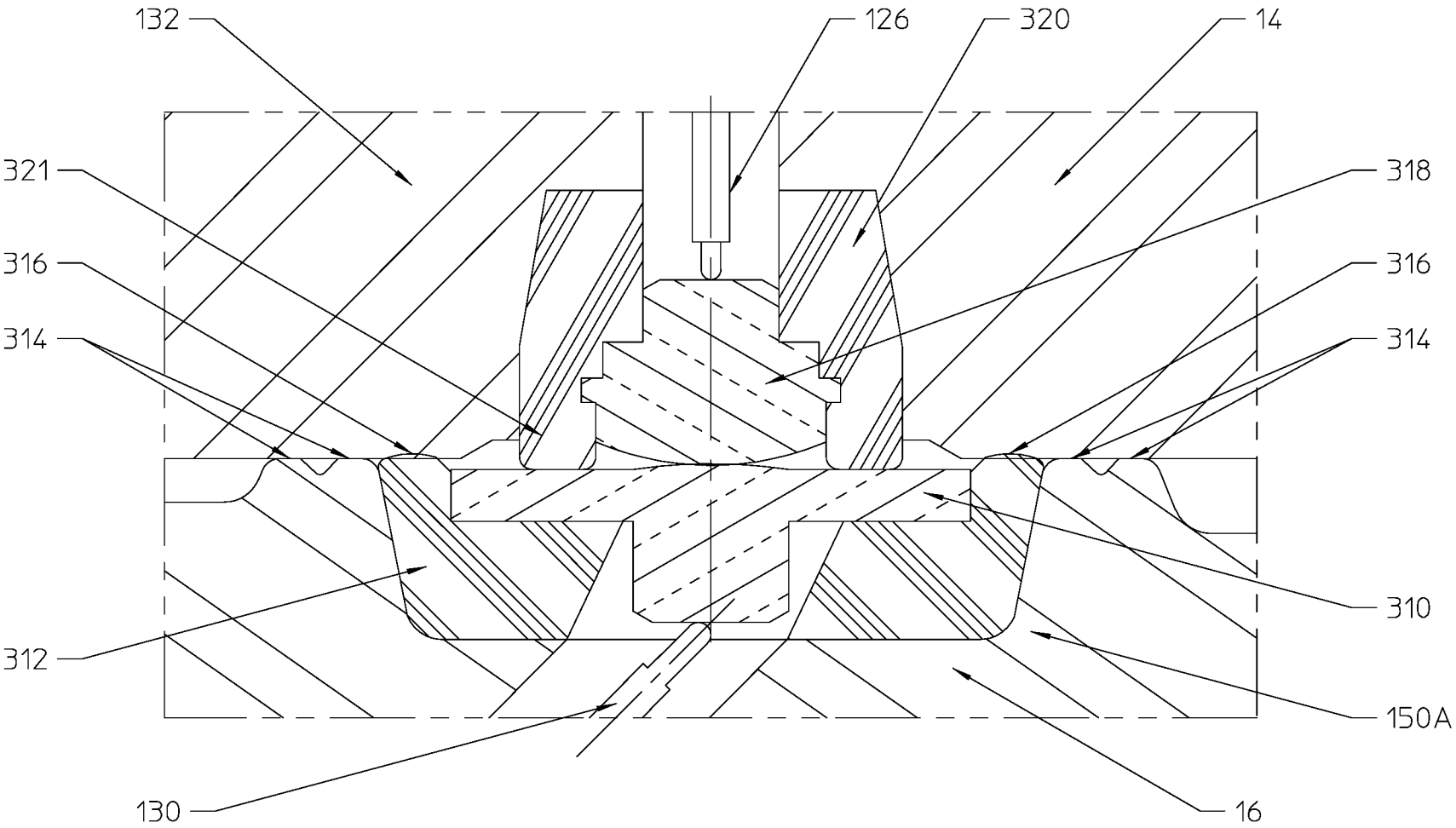
FIG. 4 is a cross-sectional view of an electrical connection formed within a scaled zone of the seal sub of FIG. 3, in accordance with an embodiment of the present disclosure.

Turning to FIG. 4, an embodiment of the electrical connection 132 that may be utilized in the disclosed seal sub 16 will now be described. The electrical connection 132 between the seal sub 16 and the tubing hanger 14 may include an electrical conductor 310 that is housed within a specific gallery (sealed zone 150A) formed by the seal sub 16. The electrical conductor 310 may be insulated via an elastomeric shroud 312 that contacts the mating side of the gallery.

As discussed above, the seal sub 16 may include a series of metal-to-metal seals 172 with corresponding elastomeric sealing components, and these are illustrated in detail in FIG. 4. Specifically, the seal sub 16 includes multiple metal-to-metal protrusions 314 configured to sealingly engage the straight inner wall 122 of the tubing hanger 14. The seal sub 16 also includes the elastomeric shroud 312, which may include protrusions 316 configured to sealingly engage the straight inner wall 122 of the tubing hanger 14 on either side of the electrical conductor 310. In this way, the elastomeric shroud 312 functions as both another sealing element of the seal 172 and an insulator for the electrical conductor 310. The metal-to-metal protrusions 314, elastomeric shroud 312 (and its protrusions 316), and the electrical conductor 310 may all extend 360 degrees about an axis of the seal sub 16, thereby filling the circumferential sealed zone 150A. FIG. 4 shows the electrical line 130 of the seal sub 16 which terminates at the electrical conductor 310 and is in electrical contact with the conductor 310.

The electrical connection 132 may also include an electrical contact 318 on the tubing hanger side of the connection. The tubing hanger 14 may include an insulating elastomeric shroud 320 (with protrusion 321) that is configured to sealingly contact the electrical conductor 310 when the seal sub 16 is landed in the tubing hanger 14. This elastomeric shroud 320 may provide a tertiary seal for the zone 150A, in addition to the metal-to-metal protrusions 314 and the elastomeric shroud 312 of the seal 172 on the seal sub 16. The electrical contact 318 and its shroud 320 may be located at a specific circumferential position within the inner wall 122 of the tubing hanger 14, or the electrical contact 318 and shroud 320 may extend 360 degrees about an axis of the tubing hanger 14 like the electrical conductor 310 of the seal sub 16. Either way, the contact 318 will make electrical contact with the conductor 310 no matter what the relative orientation is between the seal sub 16 and the tubing hunger 14. FIG. 4 shows the electrical line 126 of the tubing hanger 14 which terminates at and is electrically coupled to the contact 318.

All wires or electrical pathways through the seal sub 16, tubing hanger 14, and tree 18 are pre-installed and sealed prior to running the seal sub 16 into place to form the electrical connection of FIG. 4.

Although FIG. 4 illustrates the electrical line 130 of the seal sub 16 as being at the same relative orientation as the electrical line 126 of the tubing hanger 14, this is only to illustrate how each side interfaces with the sealed electrical connection zone 150A. When the seal sub 16 is fully landed, the electrical lines 130 and 126 will be in electrical communication regardless of the relative orientation of the seal sub 16 to the tubing hanger 14, since the sealed connection zone 150A extends through all 360 degrees about the seal sub 16. The electrical line 130 of the seal sub 16 may contact the conductor 310 at one position along the circumference of the assembly while the electrical line 126 of the tubing hanger 14 may be located at another circumferential position, but these electrical lines 126 and 130 are still connected through the scaled electrical connection zone 150A.

Figure 5:
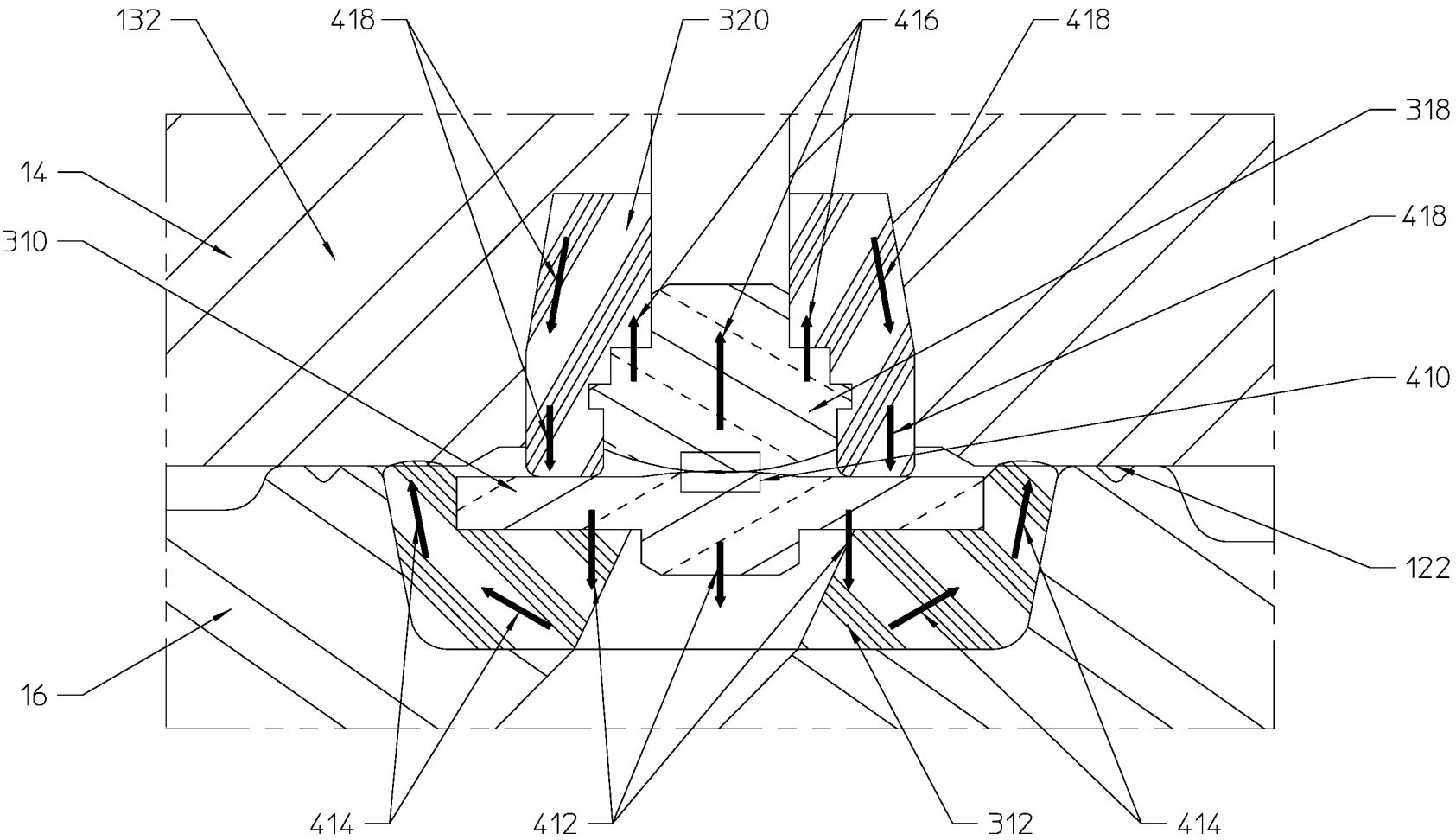
FIG. 5 is a cross-sectional view of the electrical connection and sealing components of FIG. 4 showing force transfer through these components, in accordance with an embodiment of the present disclosure.

Turning now to FIG. 5, a detailed description of the forces that connect and seal the electrical connection zone 150A will be described. The gallery 150A is sealed with the metal-to-metal seals (protrusions 314) on each side and is sealed secondarily with the compressed and deflected elastomer insulator 312 to shroud the conductor 310 and the contact 318. As the seal sub 16 is lowered into position so that the contact 318 on the tubing hanger 14 makes electrical contact with the conductor 310, the gallery 150A is sealed with the metal-to-metal seal protrusions 314 and the two compressed elastomers 312 and 320.

By conservation of volume, as tire contact 318 contacts the conductor 310 (see contact zone 410), a reaction force on the conductor 310 in a radially inward direction (arrows 412) is transferred to the elastomeric shroud 312. This reaction force causes the elastomeric shroud 312 to deform in a direction (arrows 414) of the inner wall 122 of the tubing hunger 14 to provide a secondary seal of the connection. At the same time, a reaction force on the contact 318 in a radially outward direction (arrows 416) is transferred to the elastomeric shroud 320 of the tubing hanger 14. This reaction force causes the elastomeric shroud 320 to deform in a direction (arrows 418) of the conductor 310 to provide a tertiary seal of the connection. There is a high contact pressure at the contact zone 410 that provides the desired electrical contact and the load to deflect/compress elastomers 312 and 320.

In some embodiments, a thin elastomeric skin may be molded over the contacting side of the conductor 310 so that debris does not interfere with the conductor 310 while it is being run in hole. Once the installation is complete and the electrical gallery 150A is in place, the skin is rubbed or scraped away by the conductors 310 and 318 making contact.

In some embodiments, a similar electrical connection 132 may be used to facilitate fiber optic light communications between the tubing hanger 14 and the tree 18. In such instances, the communication signal coming into and leaving the tubing hanger connection 132 would be light transmitted through a fiber optic cable. However, the signal would be converted to an electrical signal for traversing through the electrical connection 132 via the above described electrical conductor 310. Incoming light traveling through a fiber optic cable that is routed through the seal sub 16 is converted into an electrical signal, which travels through the electrical connection 132. After traveling to the contact 318 on the tubing hanger side of the connection 132, the electrical signal may then be converted back to a light signal for communication through a fiber optic cable within the tubing hanger 14.

Having described the components that make up the disclosed non-orientating connector system, a method of operating the system will now be described. Turning back to FIG. 2, first the tubing hanger 14 is run into the wellhead 12 on a running tool (not shown).

The running tool may allow hydraulic control to be maintained in the hydraulic fluid passages of the tubing hanger 14. The running tool is non-orientating and is equipped with a hydraulic umbilical. The running tool may have a sub nose that seals along the inner wall 122 of the tubing hanger 14 to isolate one or more sealed zones (e.g., to maintain a hydraulic connection between the umbilical and the tubing hanger 14 through a sealed gallery). The running tool may lock into the tubing hanger 14 and, as it enters the tubing hanger 14, press downward on the extended portion of the piston in the biasing check assembly 144 to allow hydraulic communication through the hydraulic connection.

The running tool is run subsea with the tubing hanger 14 and lands the tubing hanger 14 on the casing hanger within the wellhead 12. The tubing hanger 14 does not need to be landed in any particular orientation within the wellhead 12 during this landing operation. The running tool will then lock the tubing hanger 14 into the wellhead 12 while making a lead impression that indicates the elevation of the tubing hanger 14 relative to the wellhead 12. The running tool is unlocked from the tubing hanger 14 and, as the running tool is retrieved to the surface, the spring-loaded piston of the check assembly 144 is released to slide upward. This causes the hydraulic communication ports of the tubing hanger 14 to become misaligned to prevent intrusion of seawater into the hydraulic communication line 134 of the tubing hanger 14.

Once the running tool has been retrieved, the method may include evaluating the lead impression blocks, and running the tree 18 with the seal sub 16 subsea using a tree running tool. The tree 18 and seal sub 16 are positioned inches above their final landing position (which is shown in FIG. 2). At this point, a remote operated vehicle (ROV) will reveal the desired landing position based on the lead impression stripe made on the wellhead 12. The ROV may also indicate the fluid outlets on an upper portion of the tree 18 to a satellite jumper connection within the field. The tree running tool may then rotate the tree 18 (and seal sub 16) until the fluid outlets on the tree 18 are lined up with the jumper before lowering the tree 18 into its final position.

As the tree 18 is lowered its final inches to the landed position on the tubing hanger 14, the locking ring 142 may engage and depress the spring-loaded piston of the check assembly 144 into the chamber of the tubing hanger 14. This depression of the piston will then align the ports through the tubing hanger 14 with each other and with the hydraulic fluid connection zone 150B between the seal sub 10 and the tubing hanger 14. This lowering of the tree 18 and connected seal sub 16 relative to the tubing hanger 14 also makes up the seal sub 16 to the tubing hunger's inner wall 122 to create the gallery of sealed zones. The tree connector is then locked, and the hydraulic communication lines (136, 138, and 134) are tested. The ROV may make up the wet mate connection and then test the electrical connection 132.

As discussed at length above, the seal sub 16 incorporated with the subsea tree 18 is configured to automatically provide electrical, hydraulic, and/or fiber optic connections between the tree 18 and the tubing hanger 14, regardless of the relative orientation of the tree 18 relative to the tubing hanger 14. This provides a process for assembling a wellhead system that is faster, less expensive, and less complex than existing methods for fluidly/electrically connecting a tree to a tubing hanger landed in the wellhead.

Although the present disclosure and its advantages have been described in detail, it should be understood that various changes, substitutions and alterations can be made herein without departing from the spirit and scope of the disclosure us defined by the following claims.

What is claimed is:

1. A system, comprising:

a tubing hanger for landing in a wellhead, wherein the tubing hanger comprises a bore, a hydraulic fluid conduit, and an electrical or fiber optic line;

a tree for landing on the tubing hanger within the wellhead, wherein the tree comprises a bore, a hydraulic fluid conduit, and an electrical or fiber optic line; and a seal sub coupled to a radially inner wall of the tree and configured to be landed in and engaged with a radially inner wall of the tubing hanger, wherein the seal sub comprises:

a first series of seals disposed along a radially outer wall of the seal sub, the first series of seals defining at least one upper circumferential sealed zone between the seal sub and the tree; and a second series of seals disposed along the radially outer wall of the seal sub, the second series of seals defining at least one lower circumferential sealed zone between the seal sub and the tubing hanger;

wherein the seal sub provides a hydraulic connection and an electrical connection between the seal sub and the tubing hanger regardless of an orientation of the tubing hanger relative to the tree.

2. The system of claim 1, wherein the first series of seals is provided at an upper portion of the outer wall of the seal sub to seal an interface between the seal sub and the tree.

3. The system of claim 1, wherein the second series of seals is provided at a lower portion of the outer wall of the seal sub to seal an interface between the seal sub and the tubing hanger once the seal sub has landed in and is in engagement with the tubing hanger.

4. The system of claim 1, wherein the seal sub comprises an electrical conductor disposed between adjacent seals of the seal sub, wherein the electrical conductor extends 360 degrees about the seal sub.

5. The system of claim 4, wherein the seal sub further comprises an electrical shroud disposed around the electrical conductor to insulate the electrical conductor, wherein the electrical shroud comprises a pair of protrusions extending in a radially outward direction from the seal sub, one protrusion on each side of the electrical conductor.

6. The system of claim 4, wherein the seal sub further comprises metal-to-metal protrusions extending in a radially outward direction to sealingly engage the inner wall of the tubing hanger.

7. The system of claim 4, wherein the tubing hanger comprises an electrical contact, wherein the electrical conductor of the seal sub and the electrical contact of the tubing hanger form the electrical connection.

8. The system of claim 7, wherein the tubing hanger further comprises an elastomeric shroud disposed around the electrical contact to sealingly contact the electrical conductor when the seal sub is landed in the tubing hanger.

9. The system of claim 8, wherein the electrical or fiber optic line of the tubing hanger terminates at and is electrically coupled to the electrical contact, wherein an electrical or fiber optic line of the seal sub terminates at and is electrically coupled to the electrical conductor.

10. The system of claim 1, wherein the seal sub comprises a first passage for routing an electrical or fiber optic line of the seal sub between one of the upper circumferential sealed zones and one of the lower circumferential scaled zones.

11. The system of claim 1, wherein the seal sub comprises a second passage for routing hydraulic fluid between one of the upper circumferential sealed zones and one of the lower circumferential sealed zones through a hydraulic fluid conduit of the seal sub.

12. The system of claim 11, wherein the seal sub further comprises a fluid passage that extends radially outward from the second passage of the seal sub.

13. The system of claim 12, wherein the tubing hanger comprises a fluid passage that extends radially inward to be fluidly coupled to the fluid passage of the seal sub, wherein the fluid passage of the tubing hanger comprises two portions that are brought into alignment when the seal sub is landed in the tubing hanger.

14. The system of claim 13, further comprising a biasing check assembly, wherein the biasing check assembly comprises a piston, an extended portion of the piston, and a spring.

15. The system of claim 14, wherein the piston comprises a portion of the hydraulic fluid conduit of the tubing hanger and one of the two portions of the fluid passage of the tubing hanger.

16. The system of claim 15, further comprising a locking ring, wherein the locking ring couples the seal sub to the tree, wherein the locking ring is configured to exert a downward force onto the extended portion of the piston.

17. The system of claim 16, wherein the spring biases the piston upward against a shoulder disposed within the tubing hanger, wherein the downward force actuates the spring to compress and align the fluid passage of the tubing hanger with the fluid passage of the seal sub.

18. The system of claim 1, wherein the seal sub further comprises:

a bore;

a hydraulic fluid conduit that is fluidly coupled to the hydraulic fluid conduit of the tree; and an electrical or fiber optic line that is communicatively coupled to the electrical or fiber optic line of the tree.

19. A seal sub, comprising:

a bore;

a hydraulic fluid conduit;

an electrical or fiber optic line;

a first series of seals disposed along a radially outer wall of the seal sub, wherein the first series of seals defines at least one upper circumferential sealed zone between the outer wall of the seal sub and a tree;

a second series of seals disposed along the radially outer wall of the seal sub, wherein the second series of seals defines at least one lower circumferential sealed zone between the outer wall of the seal sub and a tubing hanger;

an electrical conductor disposed between adjacent seals of the seal sub, wherein the electrical conductor extends 360 degrees about the seal sub; and an electrical shroud configured to insulate the electrical conductor, wherein the electrical shroud comprises protrusions.

20. The seal sub of claim 19, wherein the seal sub is coupled to a radially inner wall of the tree and configured to be landed in and engaged with a radially inner wall of the tubing hanger, wherein the seal sub provides a hydraulic connection between the hydraulic fluid conduit of the seal sub and a hydraulic fluid conduit of the tubing hanger regardless of an orientation of the tubing hanger relative to the tree, wherein the seal sub provides an electrical connection between the electrical or fiber optic line of the seal sub and an electrical or fiber optic line of the tubing hanger regardless of an orientation of the tubing banger relative to the tree.

* * * * *